United States Patent [19]

Van Ketel

[11] Patent Number: 5,004,108

[45] Date of Patent: Apr. 2, 1991

[54] CRANES

[75] Inventor: Hendrik Van Ketel, Maassluis, Netherlands

[73] Assignee: 501 Heerema Engineering Service B.V., Leiden, Netherlands

[21] Appl. No.: 327,337

[22] Filed: Mar. 22, 1989

[30] Foreign Application Priority Data

Apr. 8, 1988 [GB] United Kingdom ..... 8808233

[51] Int. Cl.[5] ..... B66C 23/06; B66D 03/08

[52] U.S. Cl. ..... 212/255; 212/259; 254/399; 254/415

[58] Field of Search ..... 212/152, 167–168, 212/188, 190–194, 199–201, 211, 223–224, 227, 231–244, 252, 258, 255; 114/104, 105, 111; 254/399, 415

[56] References Cited

U.S. PATENT DOCUMENTS

| | | | |
|---|---|---|---|
| 1,291,746 | 1/1919 | Bradney et al. | 212/252 |
| 1,351,469 | 8/1920 | Coleman | 254/415 |
| 1,732,485 | 10/1929 | Ronk | 254/415 |
| 2,042,460 | 6/1936 | Fykse | 254/415 |
| 2,374,074 | 4/1945 | Berby et al. | 212/192 |
| 2,720,986 | 10/1955 | Burton | 212/167 |
| 3,976,322 | 8/1976 | Johnson | 254/415 |
| 4,343,458 | 8/1982 | Simon | 254/415 X |
| 4,565,292 | 1/1986 | Spengel, Sr. | 212/232 |

FOREIGN PATENT DOCUMENTS

| | | | |
|---|---|---|---|
| 906255 | 9/1962 | United Kingdom | 212/190 |
| 1047173 | 2/1966 | United Kingdom | 212/193 |

*Primary Examiner*—Joseph F. Peters, Jr.
*Assistant Examiner*—R. B. Johnson
*Attorney, Agent, or Firm*—Fulwider Patton Reiber Lee & Utecht

[57] ABSTRACT

The upper block assembly of a crane is connected to the crane boom via a special universal joint having a pivot axis and a hollow shaft. The cable by which the lower block assembly is suspended is fed through the hollow shaft and extends to the crane winch via a pulley mounted on the boom. Guide pulleys are arranged on the upper block assembly and universal joint respectively so that the cable extending therebetween is coincident with the pivot axis of the hollow shaft. With this arrangement, the lower pulley block has unlimited freedom to swing laterally (side lead angle).

4 Claims, 7 Drawing Sheets

CRANES

This invention relates to a crane of the kind having a boom or sheerleg which is mounted for pivotal movement about a horizontal axis.

BACKGROUND TO THE INVENTION

Conventional cranes of this kind usually have the sheave shafts of their upper and lower block assemblies arranged parallel to the boom pivot axis so that the sheave blocks can follow the pivotal movement of the boom (luffing action LA) without restriction. This is represented in FIG. 1*a* of the drawings. Normally, the allowable movement of the lower block assembly laterally (side lead angle SL) is relatively small, less than 5°, to be within the allowable fleet angle on the sheaves. This is represented in FIG. 1*b* of the drawings. In some cases, however, it may be required to have a greater side lead angle, such as when manipulating a load using two hoisting devices, as illustrated in FIG. 1*c* of the drawings. The conventional solution is to suspend the upper block assembly from the boom using a universal joint (UJ), as is shown in FIGS. 1*d* and 1*e* of the drawings. However, even with this arrangement, the side lead angle is still limited due to the fact that the lead-in sheaves (LIS) on the boom must also swivel and there are normally restrictions on the angel of adjustment which the lead-in sheaves can achieve.

BRIEF SUMMARY OF THE INVENTION

The present invention provides a crane of the kind having a boom which is mounted for pivotal movement about a first horizontal axis, an upper block assembly, a lower block assembly which is suspended from the upper block assembly by a cable system having at least one cable extending therebetween, and a joint assembly for connecting the upper block assembly to the boom, the joint assembly being connected to the boom for pivotal movement about a second horizontal axis which is parallel to the first axis and the upper block assembly being pivotally connected to the joint assembly by pivot means having an effective pivot axis which is horizontal and which lies in a plane perpendicular to said first and second axes, with winching means being provided remote from said block assemblies for winching in and paying out the cable to raise or lower the lower block assembly, wherein means is provided for guiding the cable leading between the cable system and the winching means so that a part of the cable extends along the pivot axis of the pivot means at a position perpendicular to the second axis whereby to maintain said part of the cable extending along said pivot axis despite relative pivotal movement between the upper block assembly and the joint assembly about said pivot axis.

By way of example, embodiments of the invention will now be described with reference to the accompanying drawings.

DESCRIPTION OF THE PREFERRED EMBODIMENT

Figure 1B:
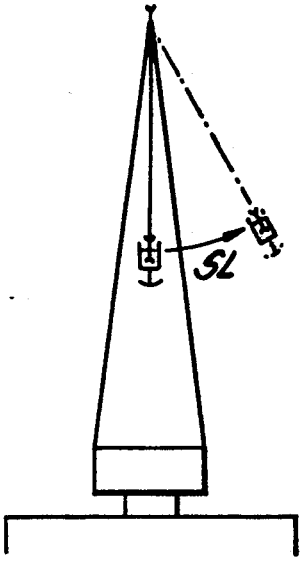
FIGS. 1*a* to 1*e* illustrate conventional crane arrangement.
Figure 1A:
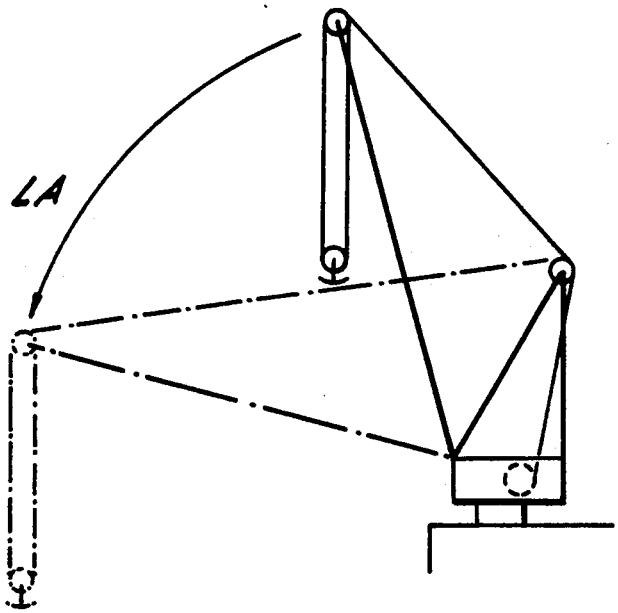
Figure 1C:
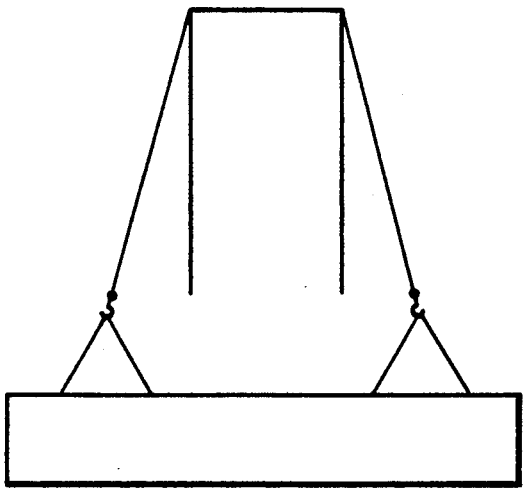
Figure 1D:
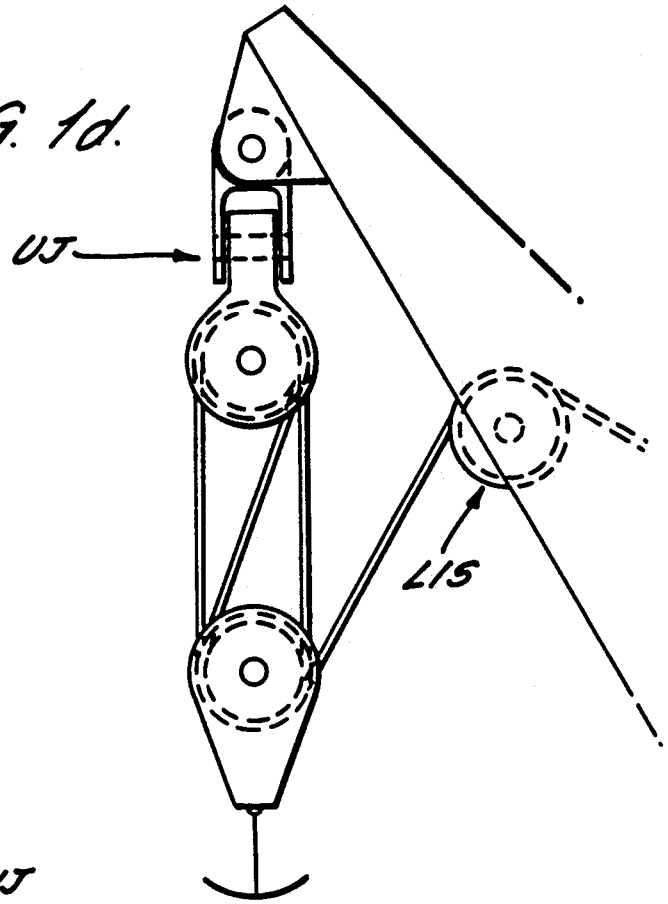
Figure 1E:
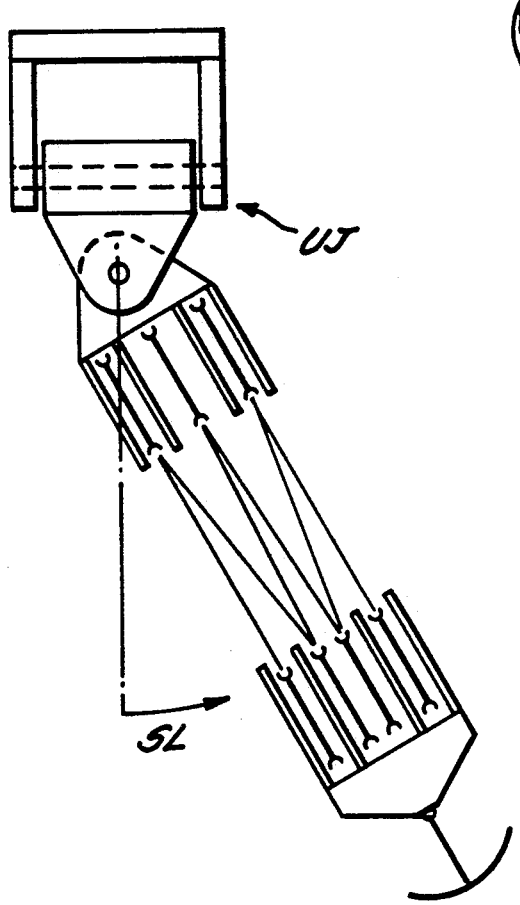
Figure 2A:
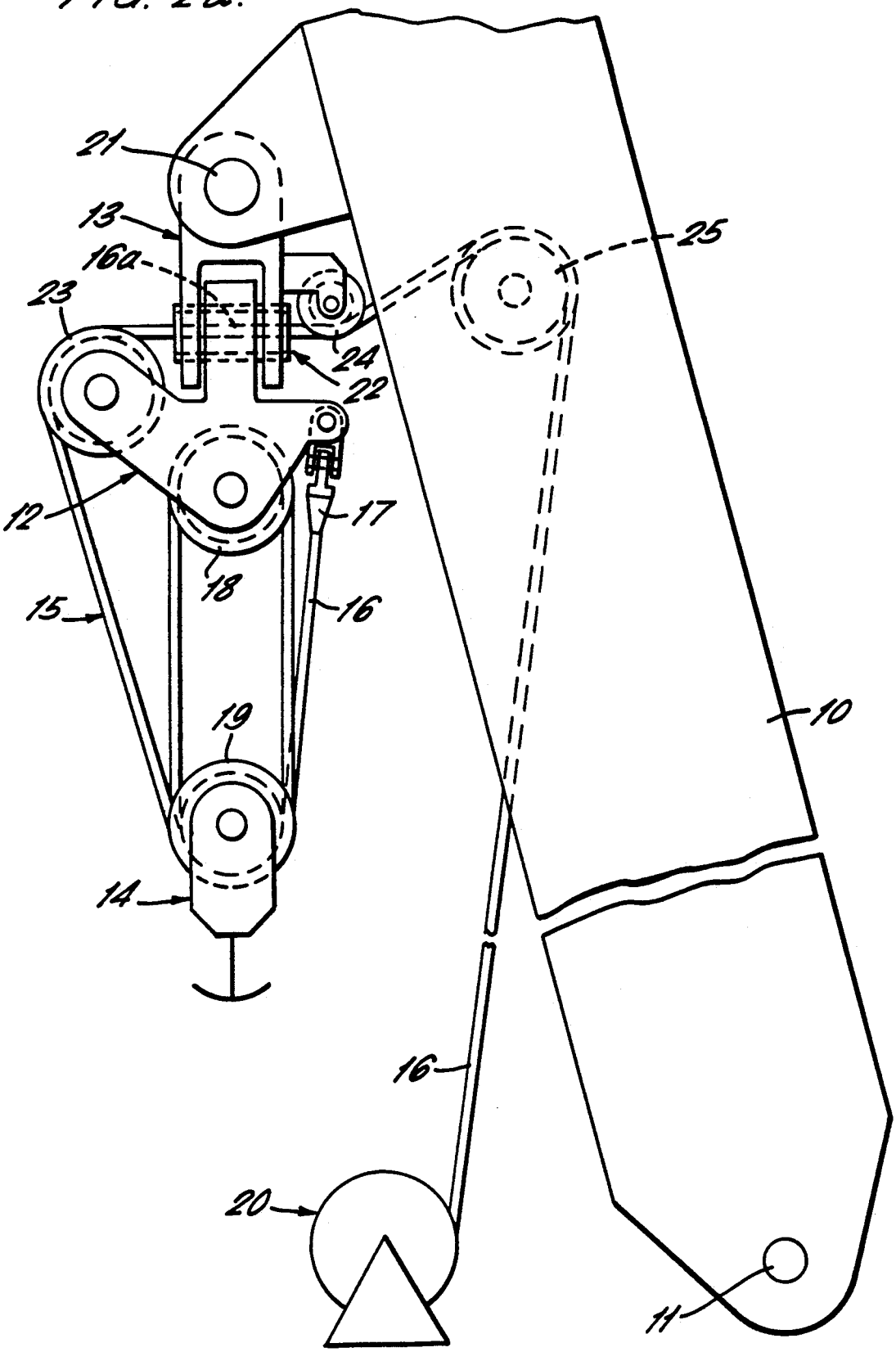
FIGS. 2*a* and 2*b* are side views showing a detail of a crane according to the present invention with, respectively, the boom in its upper and lower positions.
Figure 2B:
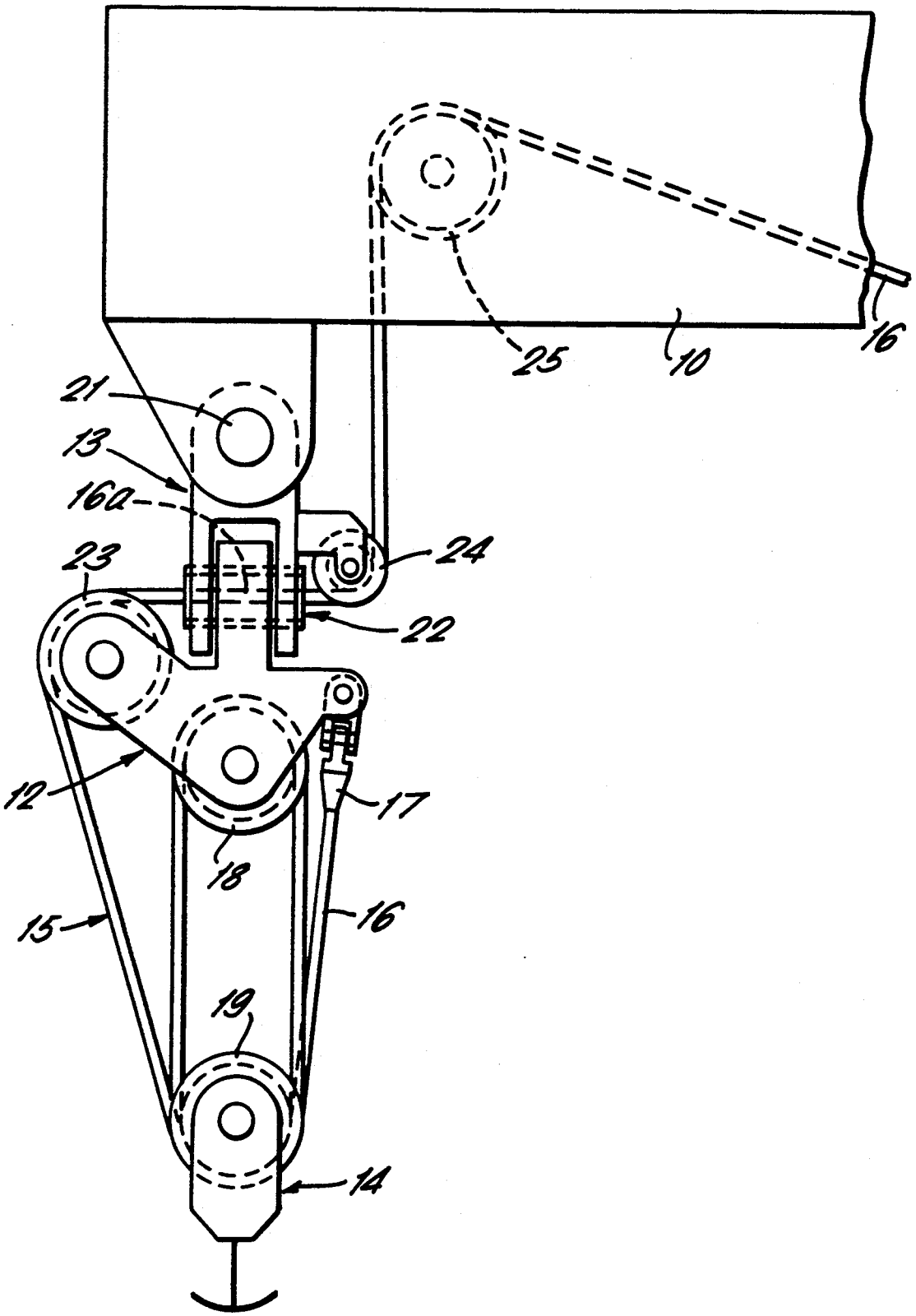

The crane seen in FIGS. 2*a* and 2*b* has a boom or sheerleg 10 which is mounted for pivotal movement about a horizontal axis 11. An upper block assembly 12 is connected to the boom 10 by means of a joint assembly 13. A lower block assembly 14 is suspended from the upper block assembly 12 by a cable system 15 extending therebetween. In the embodiment shown in FIGS. 2*a* and 2*b*, the cable system 15 comprises a single cable 16 which has a dead end 17 and which is reeved around the sheaves 18 and 19 of upper and lower block assemblies 12 and 14, and which leads with its other end to a winching unit 20. The number of turns in the cable system 15 around sheaves 18 and 19 can of course be varied to suit the lifting requirements of the crane.

The joint assembly 13 is pivotably connected to the boom 10 for relative pivotal movement about a horizontal axis 21, which is parallel to the boom pivot axis 11. The upper block assembly 12 is pivotably connected to the joint assembly 13 by a special pivot 22 which has an effective pivot axis which is horizontal and which lies in a plane perpendicular to axes 11 and 21. Special pivot 22 in this embodiment comprises a hollow shaft, which allows the cable 16 to be passed therethrough. The cable 16 is trained between a guide pulley 23 on the upper block assembly 12 and a guide pulley 24 on the joint assembly 13. The guide pulleys 23 and 24 are arranged so that the part of the cable 16*a* that extends therebetween is maintained along a path which is coincident with the pivot axis of the special pivot 22. From the guide pulley 24, the cable 16 leads to the winching unit 20 via a lead-in pulley 25 mounted on the boom 10.

Figure 3:
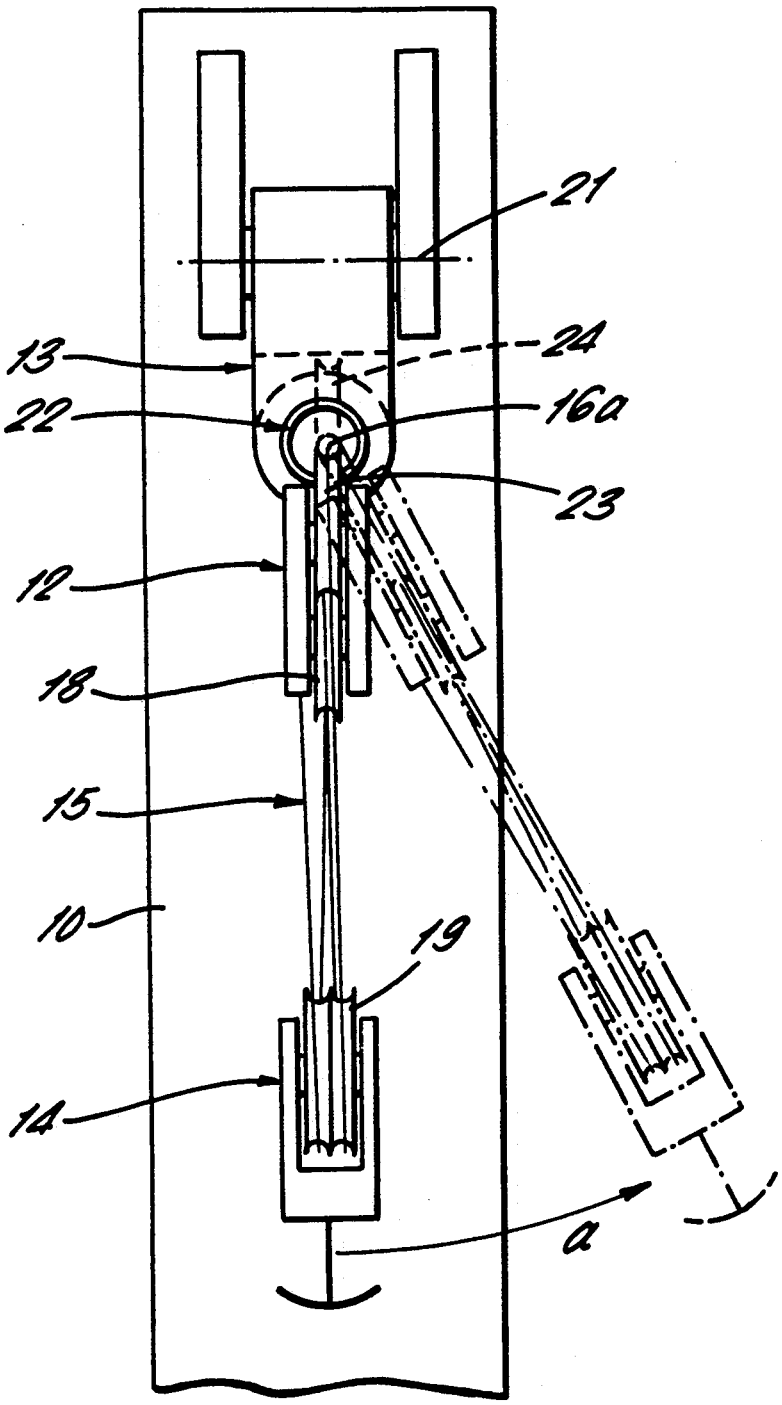
FIG. 3 is an end view showing a detail of the FIG. 2 crane.
Figure 4:
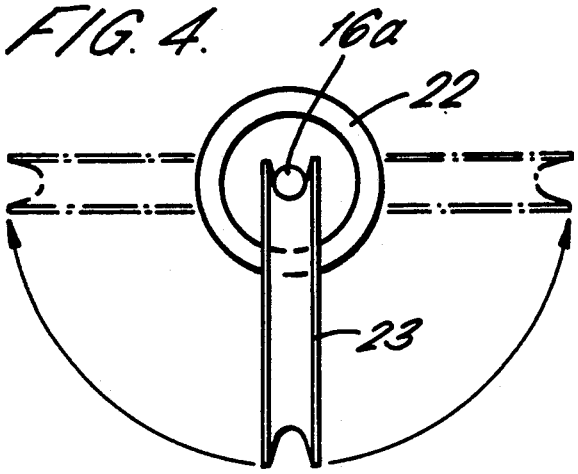
FIG. 4 is a detail form FIG. 3.

In FIG. 2*a*, the boom 10 is seen in its upper position, whereas in FIG. 2*b*, the boom is seen after its has been swung down to its lower position. In either position, and in any intermediate position, it will be seen that the upper block assembly 12 is able to swing laterally about the special pivot 22, whilst the part of the cable 16*a* remains in its position extending along the pivot axis of the special pivot 22. This is seen in FIG. 3, where the lower pulley block 14 is shown in dotted lines having swung through an angle a. It will be noted that the part of the cable 16*a* has been maintained in line with the guide pulleys 23 and 24 during this pivotal movement. Thus it will be seen that there is no restriction on the side lead angle of the crane in this arrangement. This is illustrated diagrammatically in FIG. 4, which shows the possible range of lateral angular movement (side lead angle) of the guide pulley 23.

Figure 5:
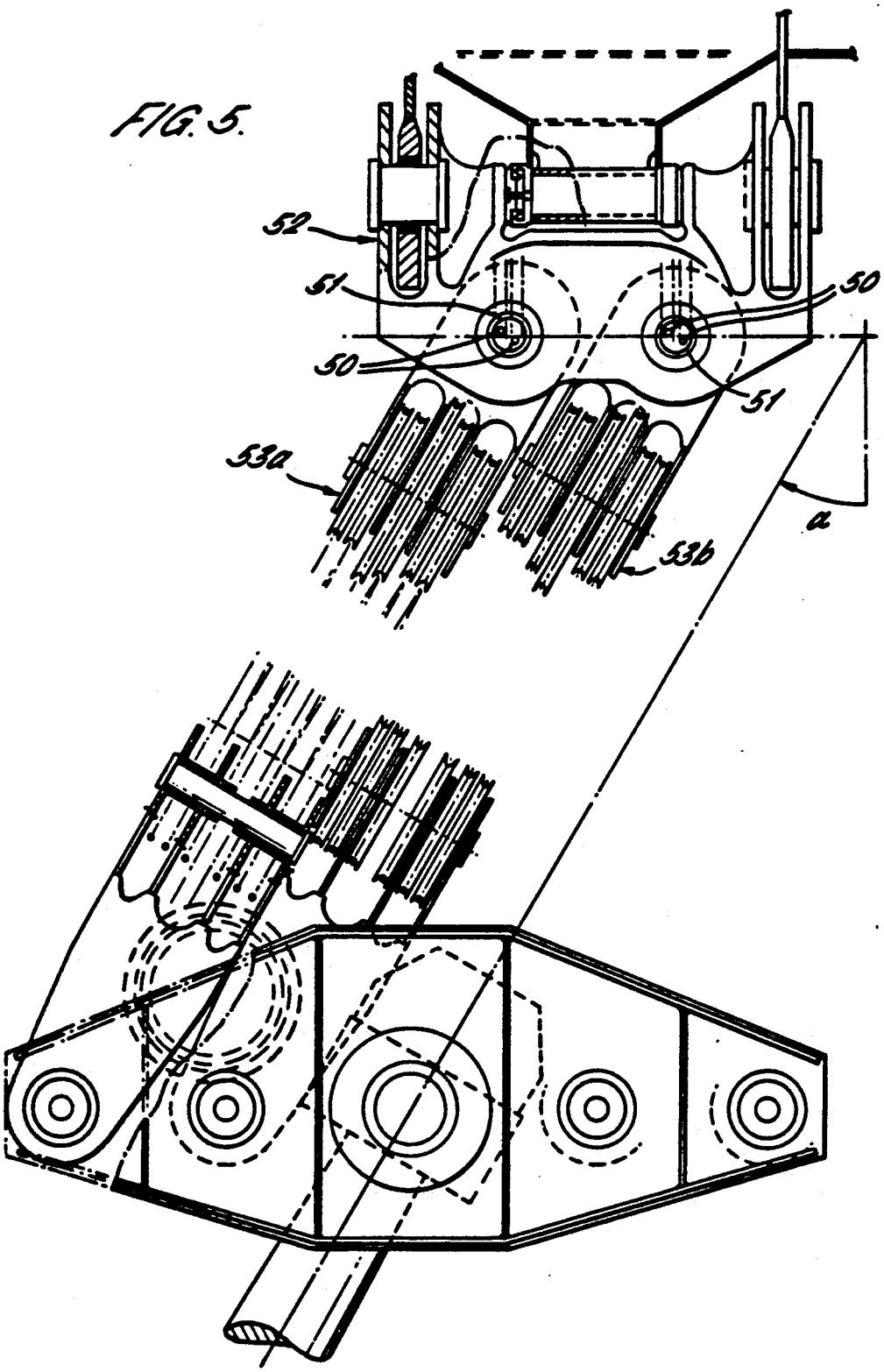
FIG. 5 is a side view showing an alternative arrangement.

The crane illustrated in FIGS. 2 and 3 is one having a simple cable system 15 having a single cable 16. It will be appreciated, however, that the cable system 15 may have two or more cables, each being trained around its own set of upper and lower sheaves. FIG. 5, for example, shows an arrangement which incorporates a cable system having multiple cables. Here, pairs of cables 50 pass through pairs of hollow shafts 51 of the special pivot joint 52, which in this case mounts a pair of upper block assemblies 53*a*, 53*b*. In this case, of course, it is not possible for both cables 50 to be maintained with both extending coincidently with the pivot axis of the hollow shaft. Instead, special consideration is given in this case to the positioning of the guide pulleys so that the cables 50 are arranged to be closely adjacent to this pivot axis. The alternative arrangement still has the advantage of a virtually unrestricted range of lateral angular movement (side lead angle).

Figure 6:
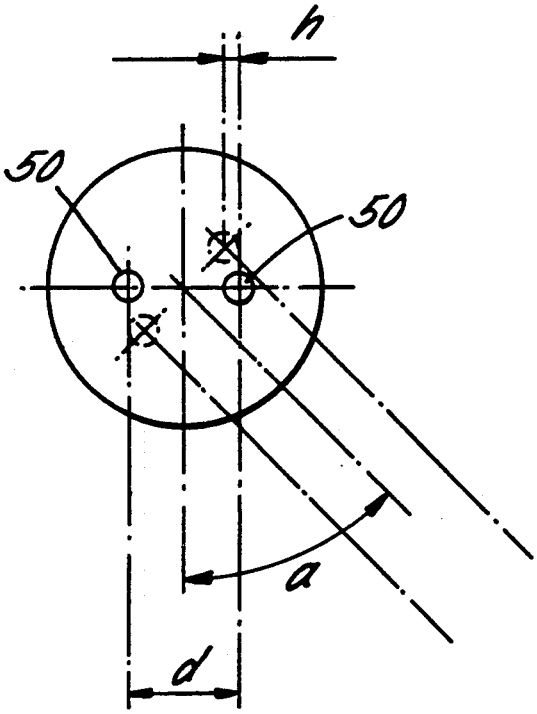
FIG. 6 and 7 are details from FIG. 5.
Figure 7:
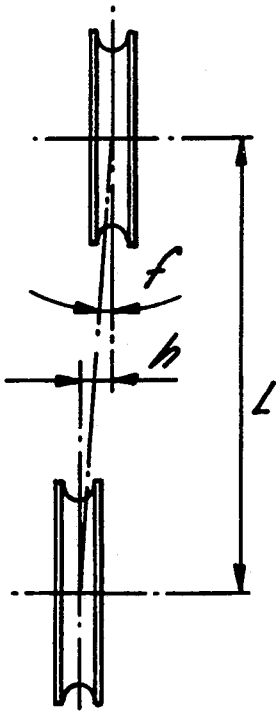

With reference to FIGS. 6 and 7, for example, if the spacing d of the two cables 50 is 300 mm and the desired side lead angle a is 45°, then for an allowable fleet angle f of 4° on the guide pulleys, the guide pulleys will have to be a distance apart L of at least 630 mm. In practice, the guide pulleys will normally be much further apart than this, so even in this example, there is hardly any restriction on the possible side lead angle.

What is claimed is:

1. In a crane of the kind having a boom or sheerleg which is mounted for pivotal movement about a first horizontal axis, an upper block assembly suspended from said boom or sheerleg, a lower block assembly, a cable system suspending the lower block assembly from the upper block assembly and having at least one cable extending therebetween, and winching means remote from said upper and lower block assemblies for winching in and paying out said cable to raise and lower the lower block assembly, the improvement comprising a joint assembly between the upper block assembly and the boom or sheerleg having first pivotal connection means between the joint assembly and the boom or sheerleg for pivotal movement of the joint assembly and upper block assembly about a second axis parallel to the first axis, and said second pivotal connection means comprises a hollow shaft to allow said cable to pass through the connection means and guide means mounted on respectively said upper block assembly and joint assembly for guiding the cable leading between said cable system and the winching means through said hollow shaft along the third axis so that a part of said cable extends in the direction of said third axis at a position perpendicular to said second axis.

2. A crane as in claim 1 wherein the cable leads to the winching means from said part of the cable which extends along said third axis via pulley means mounted on the boom.

3. A crane as claimed in claim 1 wherein said direction in which said part of the cable extends is coincident with the third axis.

4. A crane as claimed in claim 1 wherein said direction in which said part of the cable extends lies closely adjacent to the third axis.

* * * * *